United States Patent [19]

Lu

[11] Patent Number: 4,776,159

[45] Date of Patent: Oct. 11, 1988

[54] AUTOMATIC SPINDLE

[75] Inventor: Wen-Hai Lu, Taipei, Taiwan

[73] Assignee: Hellhead Enterprise Co., Ltd., Taipei, Taiwan

[21] Appl. No.: 881,116

[22] Filed: Jul. 1, 1986

[51] Int. Cl.[4] ..... B21F 15/04; B21F 7/00; B21F 9/02

[52] U.S. Cl. ..... 57/22; 57/59; 57/129; 140/118; 140/119; 140/149

[58] Field of Search ..... 57/129–135, 57/59, 22, 23; 140/118, 119, 122, 149

[56] References Cited

U.S. PATENT DOCUMENTS

| | | | |
|---|---|---|---|
| 1,436,637 | 11/1922 | Bates | 140/119 |
| 1,740,392 | 12/1929 | Donaldson | 140/119 |
| 2,186,090 | 1/1940 | Barnett | 140/119 |
| 2,725,902 | 12/1955 | Giuliano | 140/118 |
| 2,737,983 | 3/1956 | Pray | 140/118 |
| 2,964,069 | 12/1960 | Chappel et al. | 140/119 |
| 3,420,280 | 1/1969 | Allyn | 140/149 |
| 3,587,668 | 6/1971 | Ward | 140/149 X |
| 3,786,841 | 1/1974 | Albrecht et al. | 140/119 |
| 4,448,225 | 5/1984 | Schmidt | 140/119 |

*Primary Examiner*—John Petrakes

*Attorney, Agent, or Firm*—Browdy and Neimark

[57] ABSTRACT

An automatic spindle with a propeller guide and a hook provided in front of an extension of the propeller guide, the hook being attached to a filament for preparatory spinning, the back-pull given by virtue of such an arrangement serving to bring the propeller guide upwards so that a positioning rotation may be produced upon the frontal tip of the propeller guide as a plurality of engaging teeth provided over the perimeter of the sleeve that is acting upon and as fitted to the perimeter of the propeller guide are engaged respectively in the helical threads over the propeller guide. Thus the string or rope fastened to the frontal tip of the propeller guide can be twisted. A feeder is clamped to the tail end of a hand cone to accommodate the mounting of wires meant for spinning processing, and the front end of the hand cone is fitted with a clipper, thereby serving to feed the wire straight by means of the feeder in the exercise of fastening of objects, and to cut the wires.

6 Claims, 3 Drawing Sheets

AUTOMATIC SPINDLE

FIELD OF THE INVENTION

The present invention relates to a simply structured, easy-to-use, fast-acting, safe and automatic spindle serving primarily to twist and twine wires, ropes, strings, and the like.

BACKGROUND OF THE INVENTION

In common practice, the twisting and twining of various wires, ropes, and the like, for instance for the fixing of a fitting around which the wire, etc. is first looped, are done manually, which not only wastes a lot of time and labor, but also results in that the fixing of the fitting is not stable enough and will easily move out of place. For example, the fixing of pillars, such as scaffolding, pikes, or piling at a construction site or in a factory, is, as a rule, done by clamping, by twisting, turn after turn, thick wire that is first looped around the piling. Such wire or cable is supplied by the worker from a reel located for instance around his waist or from a handy position elsewhere. Holding clamps or other fixing tools are used for the fastening fixing. Since such action often requires the worker to rotate himself, this not only consumes much energy but also places the worker in a very precarious position. Also since the wire or cable comes, as a rule, already cut into uniform length, the worker will have to cut these further on the spot into suitable lengths as required in each particular situation. Where twisting fixing of larger piling is involved, it is clear that the wasted effort involved with such an undertaking is significant. The safety aspects, as well as the reliability and efficiency are far from what they should be.

In view of the many shortcomings inherent with conventional practices and applications, such as those described in the foregoing, therefore, the inventor undertook to study improvements, and succeeded as herein disclosed with the present invention of an automatic spindle together with means for supplying and cutting the wire, etc.

SUMMARY OF THE INVENTION

Accordingly, the primary object of the present invention is to provide an automatic spindle having a unique propeller guide built into it to facilitate positioning/twisting movements, so that the object meant to be twist-fastened may be twist-fastened reliably and safely, and with ease and convenience.

A further object of the present invention lies in the provision of an automatic spindle having a feeder incorporated into it at the end of a grip-cone, wherefrom orderly loaded wire or cable may be discharged in twisting twirls, to achieve a desired twisting of the wire or cable with ease and safety.

A further object of the present invention lies in the presentation of an automatic spindle, structured such that a clipper for cutting the wire or cable is built onto the front of the grip-cone. This facilitates the cutting of wire or cable drawn from the feeder to any length as required in each given application.

A further object of the present invention lies in the presentation of an automatic spindle, which by volume is small enough to allow it to be held by the user, which permits easy disassembly and reassembly, and the essential parts of which are exchangeable for different uses.

Other features and advantages of the present invention will emerge from the following description of various embodiments, which is given by way of illustration and is intended to be in any way limiting, with reference to the accompanying drawings in which:

Figure 1:
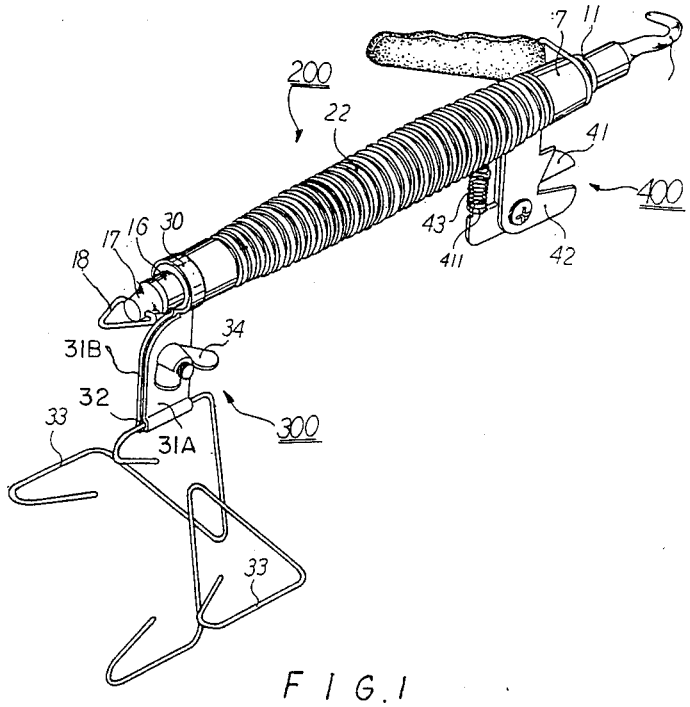
FIG. 1 is a perspective view of an automatic spindle according to the present invention.

A description of the reference numerals follows:

200: automatic spinner
300: feeder
400: clipper
5: washer
6: recovery spring
7: disc cover
8: spring ring
9, 9A, 9B, 9C: action punch
10: ratchet block
10A, 11A: ratchet teeth
11: ratchet fitting
12: propeller guide
12A: protrusion
12B: screwnut
14: hook
15: rubber stump
16: annular tail fitting
17: tail mounting ring
18: hanging hook
21: hollow body
21A: annular protrusion
21B, 23: inner threads
22: grip cone
30: clamp ring
31A, 31B: accessorial
32: clamp fitting
34: butterfly nut
33: holding means
42: lower tool
41: upper tool
411, 421: positioning bit.
43: spring

DESCRIPTION OF PREFERRED EMBODIMENTS

Referring first of all to FIG. 1, it is seen that the automatic spindle of the present invention is composed essentially of the automatic spinner 200, feeder 300, and clipper 400.

Figure 2:
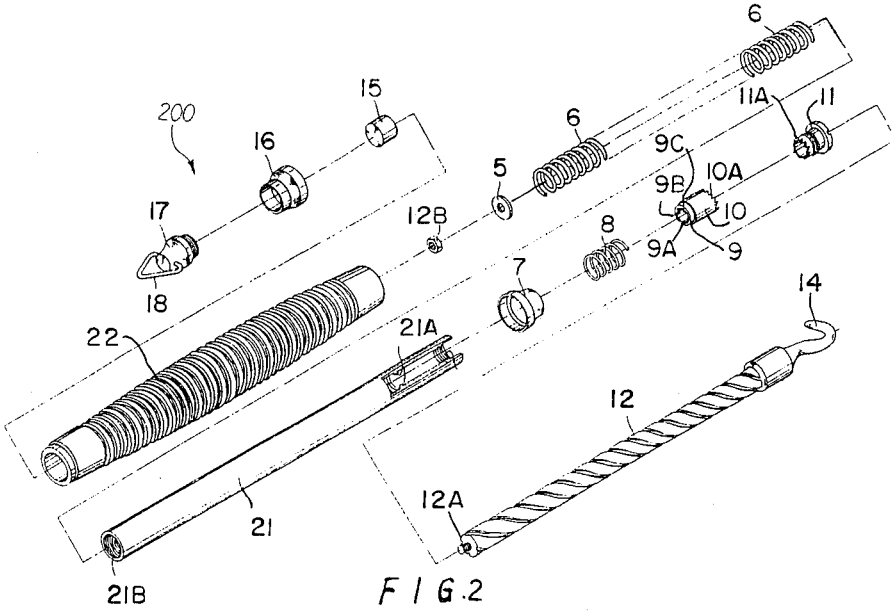
FIG. 2 is a perspective view showing details of a spinning implement which is incorporated in the automatic spindle of the present invention.
Figure 3:
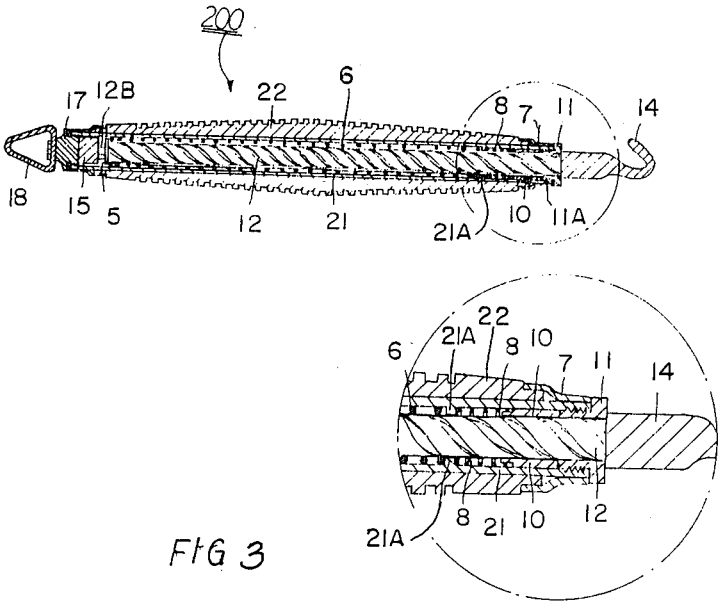
FIG. 3 is a longitudinal perspective of a spinning implement according to the present invention.

The automatic spinner 200, as better visualized in FIG. 2, consists of an oblong, cylindrical hollow body 21, a propeller guide 12, a ratchet fitting 11, a ratchet block 10, a recovery spring 6, a grip cone 22, a rubber stump 15, an annular tail fitting 16, and a tail mounting ring 17.

Figure 4:
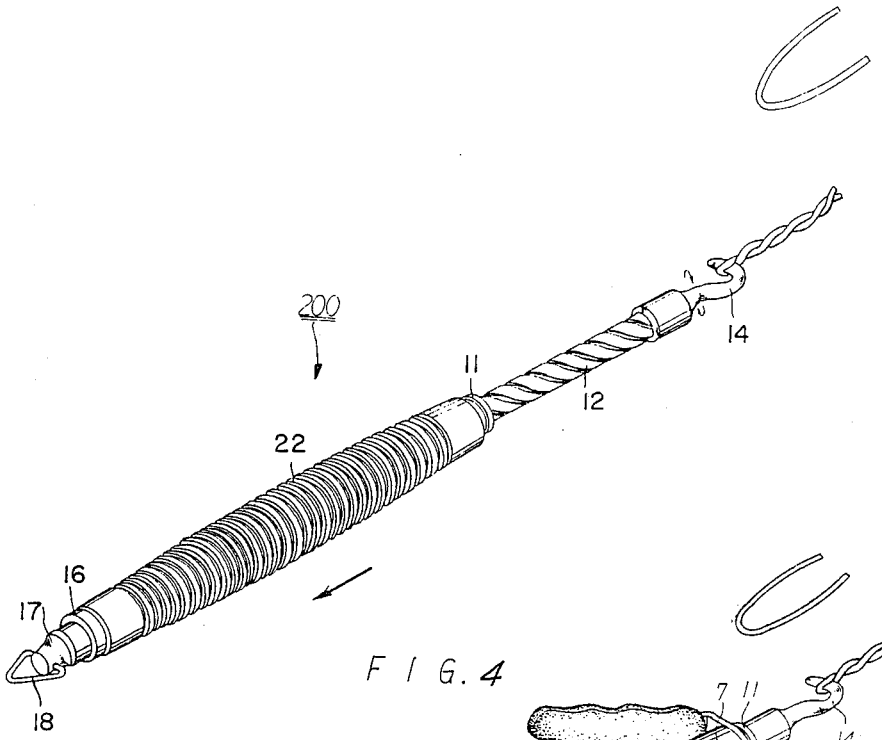
FIG. 4 indicates the use of the spinning implement according to the present invention.

The frontal tip of the propeller guide 12 is attached to a coupling hook 14, the function of which is explained in connection with FIG. 4. The coupling hook 14 can accommodate a hook of a wire, a cable or rope, to twist-fasten objects enclosed by such a wire, etc. The propeller guide 12 is mounted in a hollow body 21, and a recovery spring 6 is engaged about the propeller guide 12, One end of the recovery spring 6 is fixed to an annular protrusion 21A in the body 21, and the other end is checked by a fixing washer 5, and locked to a threaded protrusion 12A at the terminal end of the guide 12 by means of a screwnut 12B. By this the guide 12 is reset (drawn back into the hollow body 21) automatically by virtue of the elastic force acting upon it.

Next, a hollow-set ratchet fitting 11 and ratchet block 10 are introduced respectively onto the helical slots from over the end of coupling hook 14 relative to the propeller guide 12, and screwed into threads 23 enclosed in the hollow body 21 by the external threads of the ratchet fitting 11. The annular, complementary ratchet teeth 11A and 10A oppose each other to engage interactively. Four equi-distant protrusions 9, 9A, 9B and 9C inside the ratchet block 10 are provided for suitable engagement into the helical slots on the propeller guide 12. Such an arrangement yields a twisting effect for the coupling hook 14 as the propeller guide 12 is drawn or pulled out from the hollow body 21, so that the wire, cable or rope to which the hook 14 is connected may respond and twist accordingly. Thus a twisting fastening may be provided on a given object, around which the loop of wire, cable or rope is arranged. A disk cover 7 is applied as a hood over the top rim of the ratchet fitting 11, to serve as a protecting means. A spring ring 8 is attached unto the propeller guide 12, positioned between annular protrusion 21A and ratchet block 10, to provide proper tension for both the ratchet block 10 and the ratchet fitting 11. The hollow grip cone 22 engaged over the outer rim of the hollow body 21 is made of soft rubber, and has a plurality of annular layers provided over the interior to facilitate holding by the operator by virtue of friction. A rubber stump 15 is installed in the hollow body 21 to bear upon screwnut 12B. The friction is established by screwing up into the inner threads 21B over the terminal end of the hollow body 21 away from the frontal tip of a tail mounting ring 17, after an annular tail fitting 16 has been engaged onto a projecting ring over the terminal end of the hand-grip cone 22, to exert the proper bearing force against the rubber stump 15. The resulting effect is that the propeller guide 12 may reciprocate more smoothly and more stably when being pulled out and retracted. A hanging hook 18 is attached to the terminal end of the tail mounting ring 17, to facilitate coupling for setting up at a job site, such as in open field or in a workshop. The description above of the structure and operation of the automatic spinner 200 is further indicated by the assemblage as illustrated in FIG. 4.

Figure 5:
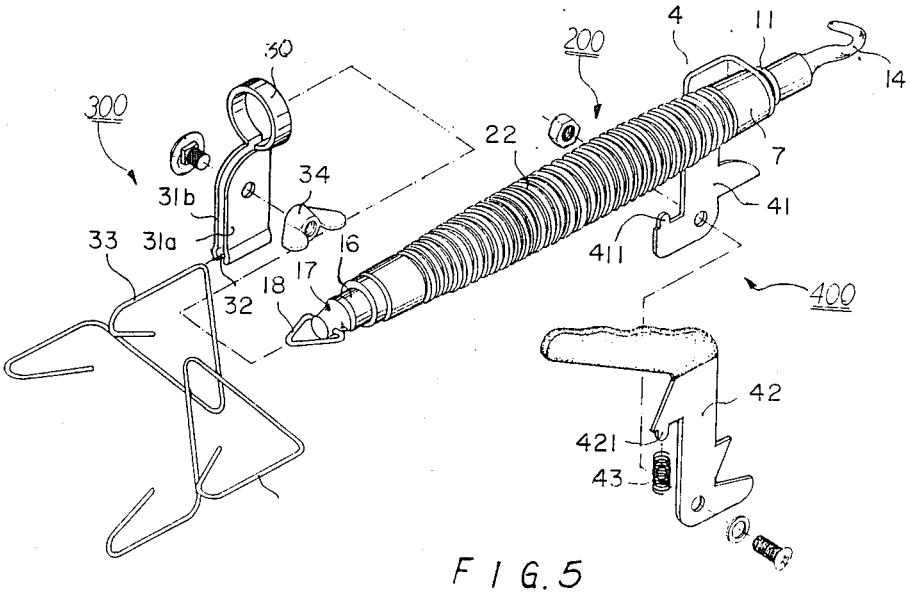
FIG. 5 is a view of the spindle element feeder together with the component and the clipper according to the present invention.

Referring to FIG. 5, it will be seen that the feeder 300 is structured to fit onto the tail mounting ring 17 of the hollow hand grip cone 22, by means of a ringlet clamp 30 which is formed with a pair of parallel shields 31A, 31B on the underside, to be fastened together by a butterfly screw set 34, an arcuated area 32 being provided on the bottom of each of the parallel shields 31A, 31B. The holding means 33 is grasped by the arcuated areas 32 and holds in an orderly manner the wire, cable or rope which is to be used to twist-fasten an object.

A clipper 400 for clipping the wire, cable or rope is fitted between the disk cover 7 and the ratchet fitting 11, and is composed of an upper cutting tool 41, a lower cutting tool 42 and a spring 43. The upper tool 41 and the lower tool 42 are held together by a set screw, and together accommodate a spring 43 by means of two positioning bits 411, 421 provided on their tail ends. Thus, a backpull is produced for the clipper 400 when the cutting tool pair performs a cut.

Figure 6:
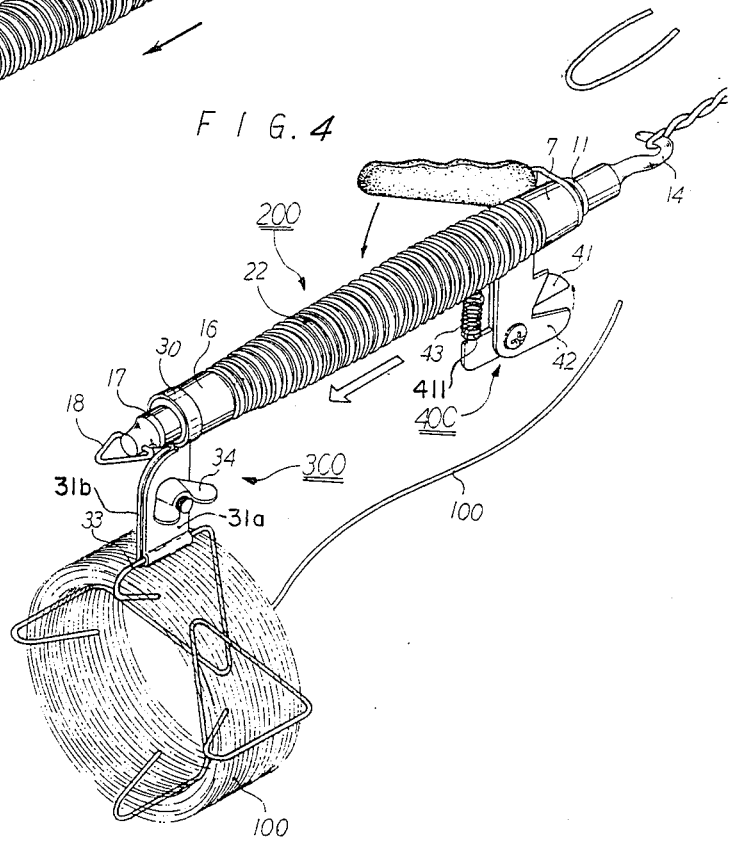
FIG. 6 is an illustration of the automatic spindle at work according to the present invention.

For further description of the operation of the device, reference is made to FIG. 6. As a first step, the wire or cable 100 that is wound in the holding means 33 is pulled out in correspondence with the size of the object to be twist-fastened. Then, the clipper 400 is depressed to cut the wire to a required length, which is looped around the object. Next, after inserting the hook 14 onto the looped wire, the hand grip cone 22 is pulled back in the manner indicated in FIG. 4, whereupon a spinning action is provided to the propeller guide 12, which serves to twist the wire or cable by means of the hook 14. This provides a binding upon the object, as a result of the twisting.

What is shown in the drawings and described above is but a non-limiting application of an embodiment of the present invention. The wire or cable can be run in groups to do the twist-fastening. For instance, when a desired force of the twisting of the rope or cable about the object is attained, the cable or wire can be held in one hand, while the other hand draws the coupling hook 14 at the frontal tip of the automatic spinner slightly crosswise, for disengaging the hook. In the meantime, the propeller guide 12, duly acted upon by the backpull of the recovery spring 6, will reset automatically.

The automatic spindle of the present invention comes as a result of numerous experiments and design improvements. Having gone through the challenge of field operation, it has been proven truly worthwhile in the elimination of many drawbacks arising out of operating with conventional manual operations, with the additional advantage that wire or cable can be fed and cut to a desired length for processing on the spot. It is therefore considered as a truly worthwhile invention offering distinct and surprising advantages over the prior art.

I claim:

1. An automatic spindle, comprising essentially an automatic spinner, a feeder, and a clipping means, wherein the automatic spinner includes a propeller guide in the form of a shaft with helical slots extending along said shaft, a hollow body having a first end and a second end which allows said propeller guide to be inserted axially thereinto and partially withdrawn therefrom.

a fitting ratchet gear connected to said first end of said hollow body through which said propeller guide is moved, ratchet means and a recovery spring, held in said first end of said hollow body of said fitting ratchet gear, a hand grip cone having a front end and a back end and fitting over and connected to said hollow body, a tail mounting ring on said back end of said hand grip cone which is connected to said second end of said hollow body, and a coupling hook provided on an end of said propeller guide corresponding to said first end of said hollow body, the feeder being mounted by means of a round clamp onto the tail mounting ring on said back end of the hand grip cone so that a wire or cable stored on said feeder can be supplied for use to be twisted by the automatic spinner, the clipping means including a clipper which is attached with the fitting ratchet gear of the automatic spinner at the front end of the hand grip cone so that the wire or cable being supplied can be cut to a length suitable for working in a particular situation, and a length of said cut wire or cable can be twisted by inserting said coupling hook into a loop thereof and pulling on said hand grip cone by a rotation of the hook cused by said propeller guide rotatingly withdrawing from said hollow body and said fitting ratchet gear engaging said ratchet means to prevent rotation therebetween, and when said hook is removed, the propeller guide is pulled back into said hollow body by said recovery spring without rotation, as a result of said ratchet means rotating with respect to said fitting ratchet gear.

2. An automatic spindle according to claim 1, wherein an annular protrusion is provided inside the hollow body near said first end, said recovery spring having a first end bearing against said annular protrusion and a second end bearing against a washer connected to the other end of the propeller guide, said recovery spring being thereby secured in a coaxial position about said propeller guide and to be compressed by said pulling said hand grip cone.

3. An automatic spindle according to claim 1, wherein a rubber stump is attached in the second end of the hollow body by a threaded shaft portion of said tail mounting ring which is screwed into the second end of the hollow body to provide a force upon the rubber stump, thereby stabilizing the rubber stump for operation of the spindle.

4. An automatic spindle according to claim 1, wherein the feeder includes two parallel shields with arcuated areas forming an annular clamp, a butterfly screw compressing said clamp, and a holding means held by the clamp and around which a stock of the wire or cable is wound in advance of the twisting operations to be performed.

5. An automatic spindle according to claim 1, wherein the clipping means at the front of the hand grip cone includes a clipper formed of an upper tool, a lower tool and a spring, the upper tool and the lower tool being united together by a screw, and positioning bits being provided on tail ends of the tools to accommodate the spring to reopen the clipper after a segment of the wire or cable is cut.

6. A device for twist-fastening a wire, rope or cable etc. around an object, said device comprising an automatic spinner, including a hook, a propeller guide to which said hook is non-rotatingly fastened, and a grip cone which engages said propeller guide for motion of said propeller guide longitudinally and rotationaly with respect to said grip cone, whereby when said hook is inserted in a loop of said wire, rope or cable extending about said object and said grip cone is pulled by the operator in a direction away from said object, said propeller guide rotates to twist said loop while extending longitudinally from said grip cone, said automatic spinner further comprising ratchet and recovery spring means for retracting said propeller guide longitudinally into said grip cone when each pulling by the operator is finished, feeder means connected to said grip cone for storing and feeding said wire, rope or cable for said twist-fastening of the object, and clipping means counted on an end of said grip cone from which said propeller guide longitudinally extends.

* * * * *